United States Patent [19]

Mastronardo

[11] Patent Number: 4,842,032

[45] Date of Patent: Jun. 27, 1989

[54] COMPACT DISC CARRYING CASE

[75] Inventor: Patrick Mastronardo, Stamford, Conn.

[73] Assignee: Lebo Peerless, Inc., Bloomfield, N.J.

[21] Appl. No.: 118,166

[22] Filed: Nov. 9, 1987

[51] Int. Cl.[4] ..... A45C 11/38; A45C 13/02; B65D 85/58; B65D 85/62

[52] U.S. Cl. ..... 206/309; 150/113; 190/109; 190/110; 190/119; 190/903; 206/316.2; 206/387; 206/444; D3/33; D3/71

[58] Field of Search ..... 190/109, 110, 119, 107, 190/903; 150/52 J, 113, 52 R; 206/387, 316, 309, 444; 24/382; D3/33, 35, 71, 74

[56] References Cited

U.S. PATENT DOCUMENTS

| | | | |
|---|---|---|---|
| D. 268,879 | 5/1983 | Outcalt | D3/33 |
| D. 272,965 | 3/1984 | Simon | D3/33 |
| D 289,106 | 4/1987 | Leiserson | D3/71 X |
| 3,491,909 | 1/1970 | Ikelheimer | 190/109 X |
| 4,003,468 | 1/1977 | Berkman | 190/28 X |
| 4,210,186 | 7/1980 | Belenson | 190/110 X |
| 4,212,377 | 7/1980 | Weinreb | 190/110 X |
| 4,403,638 | 9/1983 | Baum | 150/52 J |
| 4,463,789 | 8/1984 | Leiserson | 150/52 J |
| 4,545,414 | 10/1985 | Baum | 150/113 X |
| 4,610,286 | 9/1986 | Cyr | 190/110 X |

FOREIGN PATENT DOCUMENTS

| | | | |
|---|---|---|---|
| 3600794 | 8/1986 | Fed. Rep. of Germany | 190/110 |
| 3528862 | 2/1987 | Fed. Rep. of Germany | 190/110 |
| 1188166 | 9/1959 | France | 24/382 |
| 2354727 | 1/1978 | France | 190/107 |
| 6811304 | 2/1970 | Netherlands | 190/109 |
| 482006 | 3/1938 | United Kingdom | 190/119 |

*Primary Examiner*—Sue A. Weaver
*Attorney, Agent, or Firm*—Marvin Feldman

[57] ABSTRACT

A carrying case is designed with a removable partition so that with the partition in place, compact discs may be stored and transported, and with the partition removed, the case serves as a utility or tote bag. The partition and inside walls of the case are formed with cooperative Velcro pads so that, in one embodiment, the partition is pivoted out of position, and in another embodiment, the partition may be removed from the case. A novel dual zippered top flap provides ready access for storing the compact discs, compact disc (CD) player, camcorder or other objects.

3 Claims, 3 Drawing Sheets

FIG. 1
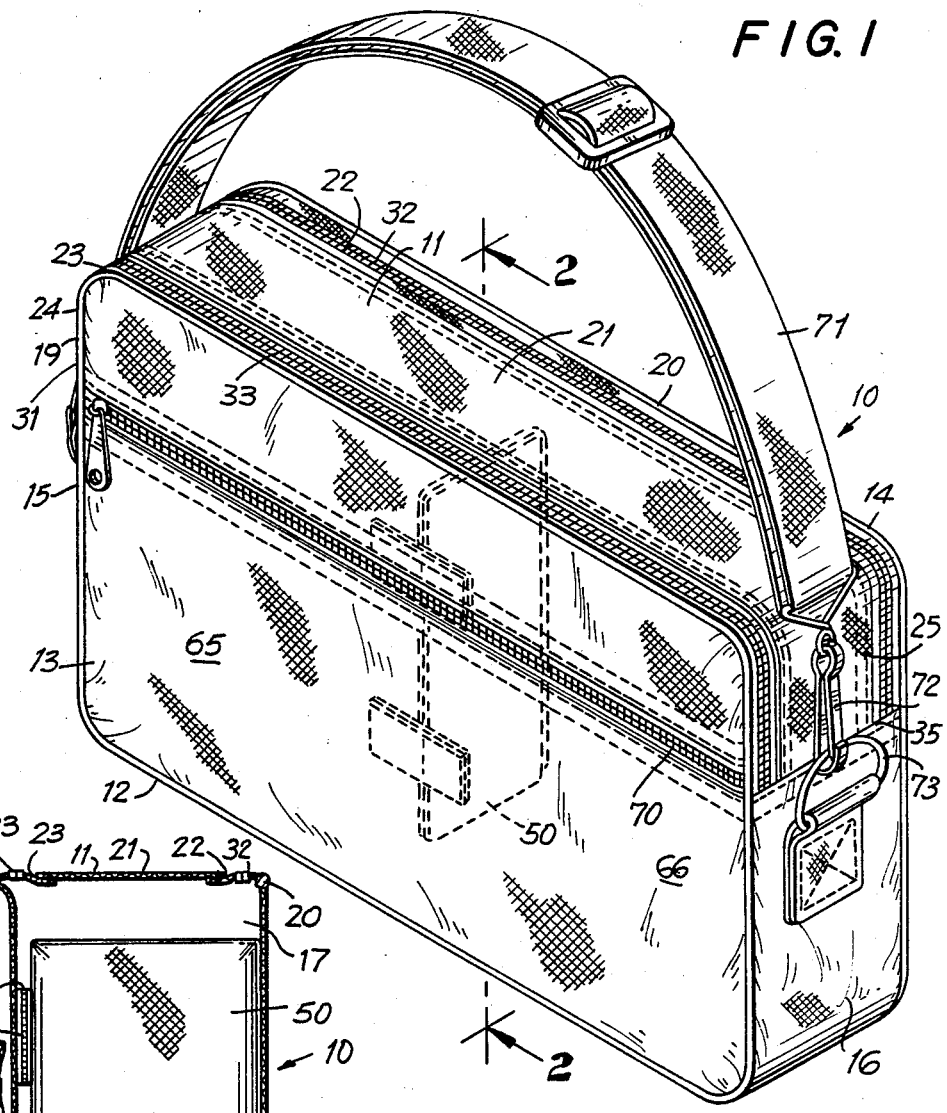
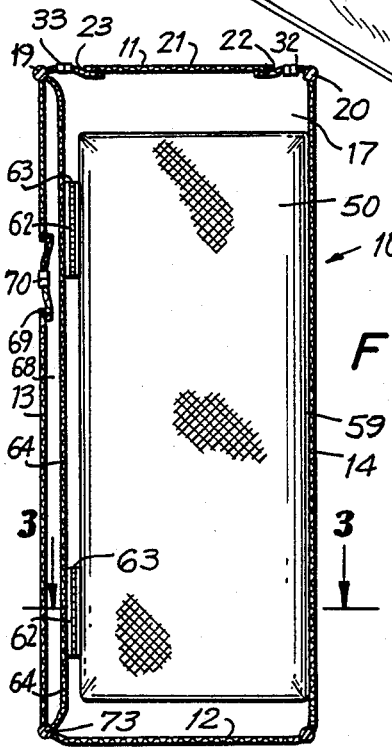
FIG. 2
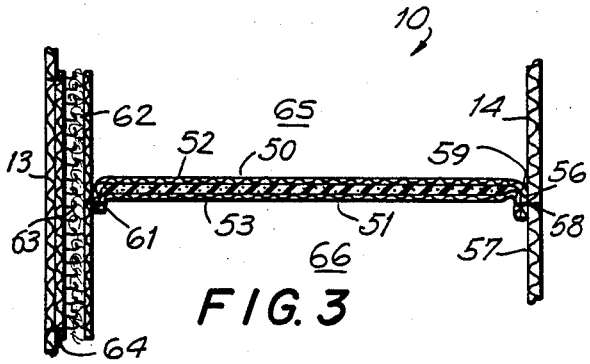
FIG. 3

COMPACT DISC CARRYING CASE

BACKGROUND OF THE INVENTION

1. Field of the Invention

This invention relates to carrying cases. More specifically, this invention related to multiple function carrying case.

2. Discussion of the Prior Art

Heretofore, carrying cases were designed to hold boxed and unboxed audio cassettes, which cases had molded plastic trays bonded in the case. The molded plastic trays were formed to hold the cassettes in place. Typical prior art constructions are disclosed in U.S. Pat. No. 4,003,468 granted July 18, 1977 to Berkman, and U.S. Pat. No. 4,117,931, granted Oct. 3, 1978 to Berkman.

These prior art constructions were rigid or semi-rigid and had the single-minded purpose of the storage of cassettes.

The art desired a more versatile carrying case.

The art also desired a carrying case that was specifically useful for the storage of compact discs, in contradistinction to audio cassettes.

SUMMARY OF THE INVENTION

A carrying case of flexible design is formed with a removable or pivotable partition disposed inside the case. The case with the partition in place is for the storage and transport of compact discs, and with the partition pivoted or removed, the case serves as a utility case or tote bag. The partitions are formed with Velcro edge panels which cooperate with Velcro receptive material on the inside walls of the case. The carrying case is formed with a novel dual-acting zipper for ready access to the compact discs inside the case. The flexible carrying case is formed substantially from washable fabric materials.

BRIEF DESCRIPTION OF THE DRAWINGS

FIG. 1 is a perspective view of a first embodiment of the carrying case showing the internal partition construction in broken line view;

FIG. 2 is a sectional view taken along line 2—2 of FIG. 1;

FIG. 3 is an enlarged fragmentary sectional view taken along line 3—3 of FIG. 2;

DESCRIPTION OF THE PREPARED EMBODIMENTS

Figure 4:
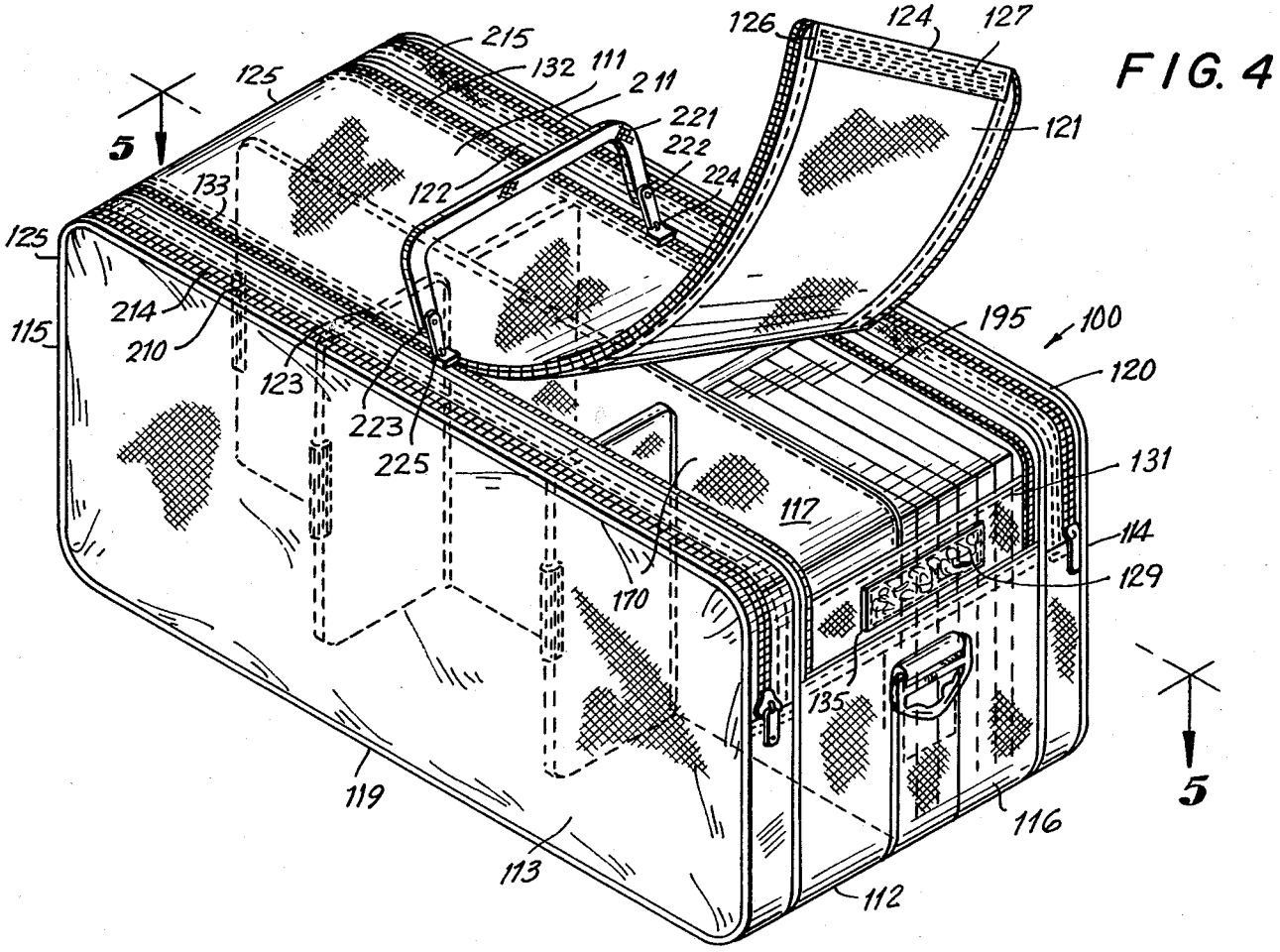
FIG. 4 is a perspective view of a second embodiment of the carrying case showing the internal partition construction in broken line view and the top partially opened.

Referring to FIGS. 1-3, there is shown a first embodiment of the invention, generally referred to as 10. Carrying case 10 is, in general, formed of a top 11, bottom 12, front 13, back 14, and opposed ends 15 and 16, which are joined so as to form a main compartment 17. Specifically, front 13 is affixed to top 11, ends 15 and 16, and bottom 12 by means of piping or welting 19. And back 14 is affixed to top 11, ends 15 and 16, and bottom 12 by means of piping or welting 20, to form an integral unit.

Top 11 is formed with a flap 21 having opposed parallel edges 22 and 23, and transversely disposed ends 24 and 25. Flap end 24 is provided with a Velcro pad (not shown) which is stitched at 26 to end 24. A cooperative Velcro pad (not shown) is stitched to case end portion 31. Flap end 25 is stitched at 35 to case end 16. A pair of zippers 32 and 33 are provided at edges 22 and 23, respectively. Zippers 32 and 33 are formed with heads which heads are connected to a strap (not shown). In this manner of construction, the flap and end Velcro pads are disengaged, and the strap is pulled away from end 24, and in turn pulls zippers 32 and 33, thereby opening zippers 32 and 33, providing ready access to compartment 17. The zippers may be opened first and then the Velcro pads disengaged to open the case.

As best shown in FIG. 3, a wall or partition 50 is formed of a stiffener piece 51 covered by fabric pieces 52 and 53. Partition 50 is formed with edge 56 which is affixed to the inside 57 of back 14 by stitching 58, in a manner so that pieces 52 and 53 form flexible L-bend or pivot 59, as will be further explained hereinafter. Partition 50 is formed with opposite edge 61 which is stitched to two Velcro pads 62. Cooperative Velcro pads 63 are stitched to the inside fabric piece 64 which faces front 13. In this manner, pads 63 engage pads 62, and partition or wall 50 forms two separate compartments 65 and 66 for receiving compact discs. With disengagement of pads 63 and 64, partition 50 is pivoted at 59 away from front 13 so as to form singular compartment 17 for storage of a CD player or camcorder or for general storage. It is to be noted that when partition 50 is pivoted, it is parallel and adjacent to back 14. The inside piece 57 is of Velcro receptive material so that partition pads 62 engage inside piece 57 to hold the partition in place to form compartment 17.

Inside fabric piece 64 is held by welting 73 to front 13 so as to form a pocket 68. A slot 69 is formed in front 13 and a zipper 70 is provided to open and close slot 69 for access to pocket 68. This front pocket construction complements the utility or tote bag character of case 10.

A shoulder strap 71 with detachable hook 72 and loop ends 73 is provided to complete the construction.

Figure 7:
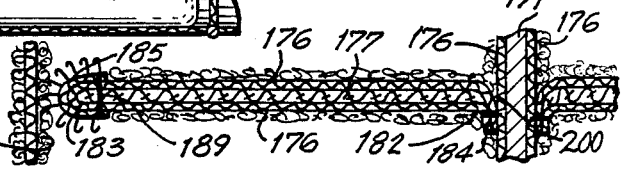
FIG. 7 is an enlarged fragmentary sectional view taken along line 7—7 of FIG. 6.

Referring now specifically to FIGS. 414 7, there is shown the second embodiment, carrying case 100. Case 100 is formed with top 111, bottom 112, front 113, back 114 and opposed ends 115 and 116, which are joined so as to form a main compartment 117. Specifically, front 113 is affixed to top 111, ends 115 and 116 and bottom 112 by means of piping or welting 119. And back 114 is affixed to top 111, ends 115 and 116 and bottom 112 by means of piping or welting 120, to form integral case 100.

Top 111 is formed with a flap 121 having opposed parallel edges 122 and 123, and transversely disposed ends, namely, free end 124 and fixed end 125. Free end 124 is provided with a Velcro pad 127, stitched at 126 to end 124. A cooperative Velcro pad 129 is stitched at 135 to case end portion 131. Fixed end 125 is stitched to case end 115. A pair of zippers 132 and 133 are provided at edges 122 and 123, respectively. Handle 221 is connected at its ends 222 and 223 to the heads 224 and 225 of zippers 132 and 133, respectively. With the disengagement of pad 127 from pad 129, U-shaped handle 221 is pulled towards fixed end 125, in turn pulling zippers 132 and 133, thereby opening flap 121 for access to compartment 117.

Partition 170 is formed of a middle wall 171 and four transverse walls 172. Two walls 172 and about one-half of the middle wall 171 form a cross-shaped portion 173, so that partition 170 is, in effect, formed of two cross-shaped portions 173. Wall 171 is formed of a stiffener 175 covered by two fabric pieces 176, and each transverse wall 172 is formed of a stiffener 177 covered by two fabric pieces 178. Each wall 172 is formed with an inside edge 182 and an outside edge 183. Inside edge 182 is attached to middle wall 171 by stitching 184 to form a L-bend or pivot 200. Outside edge 183 is covered with two Velcro pads 185 which are held in place by stitching 189. Middle wall 171 is formed with oppositely dispsoed edges 187 which are covered by Velcro pad 188 held in place by stitching. The inside portions 190, 191, 192 and 193 of the front 113, back 114 and ends 115, 116, respectively, are formed of fabric which is Velcro attachable. The same or similar fabric is used for fabric pieces 176.

Figure 5:
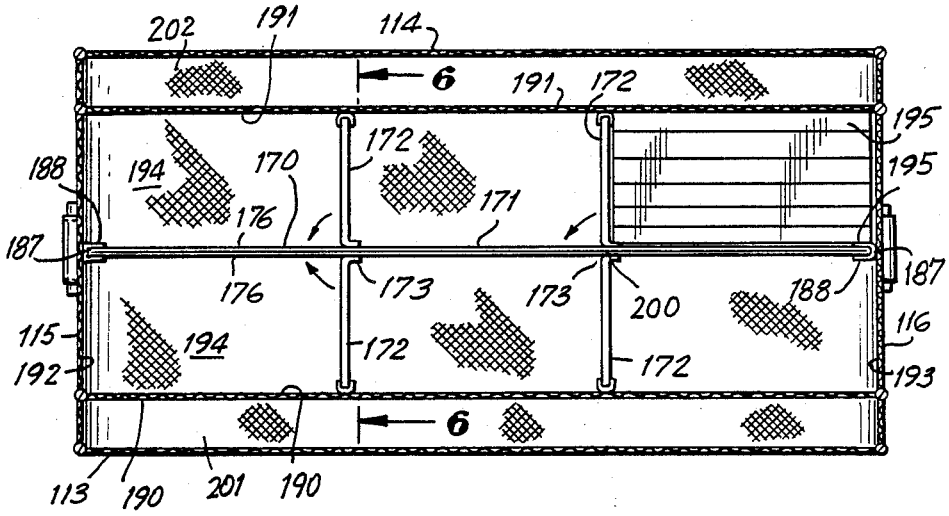
FIG. 5 is a sectional view taken along line 5—5 of FIG. 4.
Figure 6:
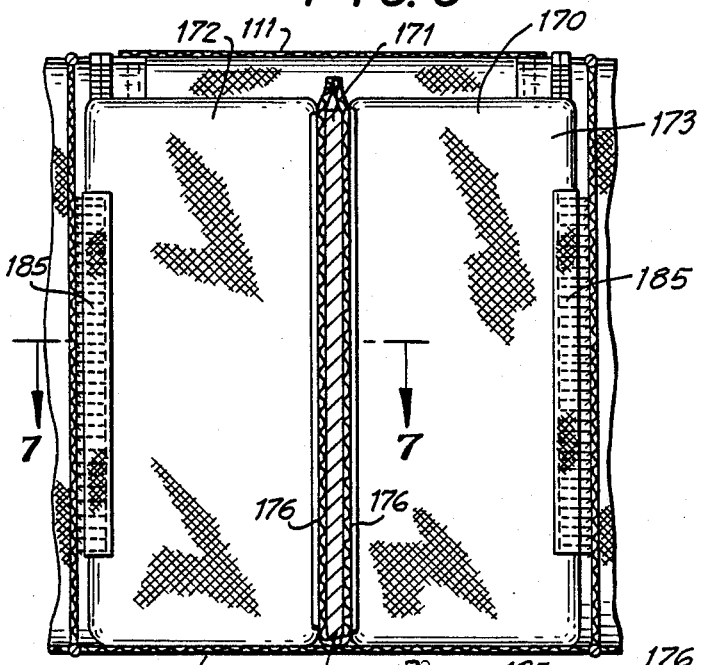
FIG. 6 is an enlarged fragmentary sectional view taken along line 6—6 of FIG. 5.

In this manner of construction, partition 170 is placed into case 100 and Velcro pads 185 are attached to the fabric front portion 190 and fabric back portion 191. Velcro pads 188 are attached to end fabric portions 192 and 193. With all the Velcro pads attached the double cross partition 170 provides six equal compartments 194. Each compartment 194 holds six compact discs 195, so that the entire construction holds 36 compact discs. If desired, each Velcro pad 185 of a transverse wall 172 may be disengaged from the front or back, as the case may be, and the disengaged wall 172 pivoted at 200 (see arrows FIG. 5), so that wall 172 is parallel and adjacent to middle wall 171, as best shown at 196. Velcro pads 185 are then attached to middle wall fabric piece 176 to hold the transverse wall in the parallel position. In this latter mode, two adjacent compartments 194 are connected to form a double-size compartment. In this manner various sized combinations of compartments may be formed to hold other objects in addition to the compact discs.

Of course, the entire partition 170 may be removed from the case, and a particularly large object such as a camcorder (not shown) may be stored in the case.

The present construction also contemplates a pair of pockets 201 and 202, with one pocket 201 formed of the front 113 and back inside fabric piece 190, and the other pocket 202 formed between back 114 and back inside fabric piece 191. Pockets 201 and 202 have openings 210 and 211. Zippers 214 and 215 are provided at openings 210 and 211. Case 100 is thus formed with the main storage compartment 117 as well as storage pockets 201 and 202.

Attachment elements 220 are stitched to ends 115 and 116 for attaching a shoulder strap (not shown) to complete the case 100 construction.

What is claimed is:

1. A carrying case for compact discs comprising; a case having elongated opposed front and back sides, opposed elongated top and bottom, and opposed end sides forming a first compartment in the case; a cross-shaped partition comprising one elongated wall between the end sides and extending upwardly from the bottom, further comprising Velcro means at the edges of each of the cross walls, said sides having means for detachably attaching the Velcro means so that the partition is disposed in the case, and with the partition disposed in the case, four second compartments are provided wherein at least one partition wall comprises means to pivot said wall relative to the other immediately adjacent walls and away from said sides, whereby with detachment of the Velcro means of said one partition wall is detached from the respective side and the one partition wall is pivoted to be parallel to the immediately adjacent walls, said top and said end sides forming a detachable flap with opposed parallel edges and transversely disposed ends, one of said ends being fixed and the other being a free end, and further comprising two zippers in parallel disposition, disposed at the opposed edges of the flap, whereby with opening the zippers, the flap is pulled away from the case for access to the compartments, and further comprising cooperative Velcro means disposed on said free flap end and on one of said case end sides, and further comprising stitching means at the fixed flap end for affixing to said other end side, whereby with opening of the zippers the flap Velcro means is detached from the end side Velcro means and the flap pulled over the elongated wall towards the other case end side, further comprising a member having opposite ends and cooperative means for attaching said member ends to a respective zipper so that when the member is pulled the zippers are simultaneously opened or closed and, said front and back sides each comprising a pair of pockets, each said pocket being disposed parallel to and adjacent one of each said flap zippers, and each pocket comprising a zipper, and wherein the compact discs are disposed in said second compartments for ready removal from the case.

2. The carrying case of claim 1, said member being U-shaped.

3. The carrying case of claim 1, said member comprising a handle.

* * * * *